United States Patent [19]

Frenette

[11] 4,143,639

[45] Mar. 13, 1979

[54] FRICTION HEAT SPACE HEATER

[76] Inventor: Eugene J. Frenette, Box 255, Derry, N.H. 03038

[21] Appl. No.: 826,557

[22] Filed: Aug. 22, 1977

[51] Int. Cl.[2] ..... F24C 9/00
[52] U.S. Cl. ..... 126/247; 122/26
[58] Field of Search ..... 126/247; 122/26

[56] References Cited

U.S. PATENT DOCUMENTS

| | | | |
|---|---|---|---|
| 2,251,344 | 8/1941 | Tesch | 126/247 |
| 2,467,425 | 4/1949 | Gobb | 236/10 |

FOREIGN PATENT DOCUMENTS

| | | | |
|---|---|---|---|
| 760213 | 2/1934 | France | 122/26 |

OTHER PUBLICATIONS

A.P.C. Application of Beldimano, Ser. No. 326,790, published May 11, 1943.

*Primary Examiner*—William E. Wayner
*Assistant Examiner*—L. I. Schwartz
*Attorney, Agent, or Firm*—Pearson & Pearson

[57] ABSTRACT

A furnace or space heater is operable at low cost by a small electric motor which rotates an elongated cylindrical drum on a vertical axis, within an elongated cylindrical casing at a clearance of about one eighth of an inch in the annular chamber formed therebetween. A supply of light lubricant normally occupies the lower portion of the annular chamber but rises to fill the chamber during rotation of the drum. The casing is enclosed in a housing, having a fan chamber containing an electric motor and fan or blower. The motor shaft may rotate both the fan and the drum.

8 Claims, 3 Drawing Figures

Fig.1.
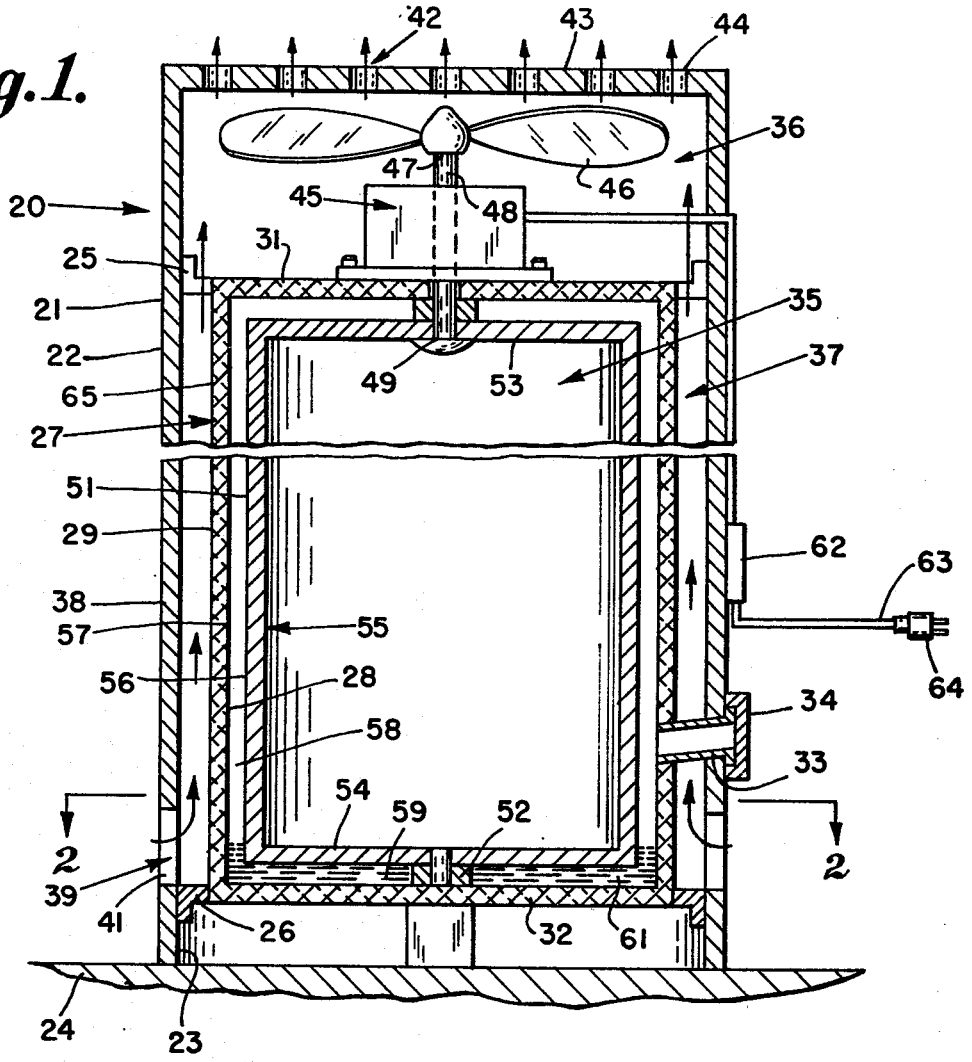
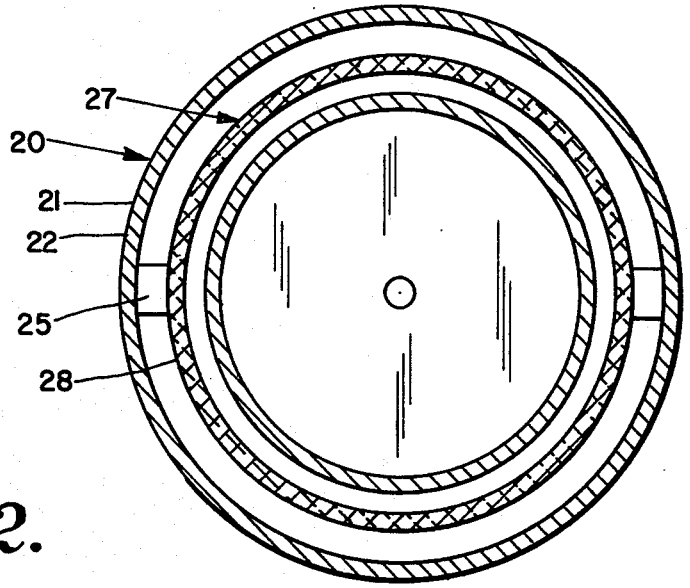
Fig.2.

FRICTION HEAT SPACE HEATER

BACKGROUND OF THE INVENTION

It has heretofore been proposed in U.S. Pat. No. 1,650,612 to Deniston of Nov. 29, 1927 to rotate a stack of discs relative to a coaxial stack of fixed discs on a horizontal axis within a casing to generate frictional heat in hot water flowing through the lower portion of the casing. In this heating device a supply of oil is contained in the upper portion of the casing to lubricate the discs and to float on the water at a predetermined level.

In U.S. Pat. No. 3,333,771 to Graham of Aug. 1, 1967, a pair of vaned rotors are each enclosed within a chamber of a casing, and mounted to rotate in a vertical plane on a horizontal axis as depicted in FIG. 7 thereof. As in the Deniston patent water flows through the device and is heated by friction.

In U.S. Pat. No. 4,004,553 to Stenstrom of Jan. 25, 1977 a single disc like rotor is revolved on a horizontal axis in a vertical plane, within a casing to heat water passing through the device.

SUMMARY OF THE INVENTION

Unlike the above mentioned patents wherein thin discs or vanes, in single or stack configuration, comprise the rotor, in this invention an elongated, cylindrical smooth surfaced, inner drum is the rotor. The drum is rotated in a horizontal plane on a vertical axis within an elongated cylindrical, smooth surfaced casing, or outer drum, to form an annular sealed, liquid, chamber therebetween having a clearance of about one eighth of an inch. A quart of relatively light oil is captive in the annular chamber and at rest occupies only the bottom thereof. However upon rotation of the drum, by an electric motor of about one horse power, the oil rises to fill the chamber due to the pumping action of the drum.

Thus friction heat is generated not by two metal, or other, surfaces contacting each other, but by the contact of the opposing surfaces with the oil which not only lubricates but generates heat.

A portable space heater is formed by enclosing the casing and drum in the lower chamber of a housing and drawing ambient air inwardly and around the heated outer surface of the casing for fan discharge back into the ambient atmosphere by a large diameter, eight bladed fan driven by the drum motor, or preferably by a separate motor. For use as a furnace an air blower and separate electric motor blow ambient air around the casing for discharge into a heating system.

BRIEF DESCRIPTION OF THE DRAWING

FIG. 1 is a front elevational view of the portable space heater of the invention, in half section;

FIG. 2 is a top plan view in section on line 2—2 of FIG. 1; and

DESCRIPTION OF A PREFERRED EMBODIMENT

Figure 3:
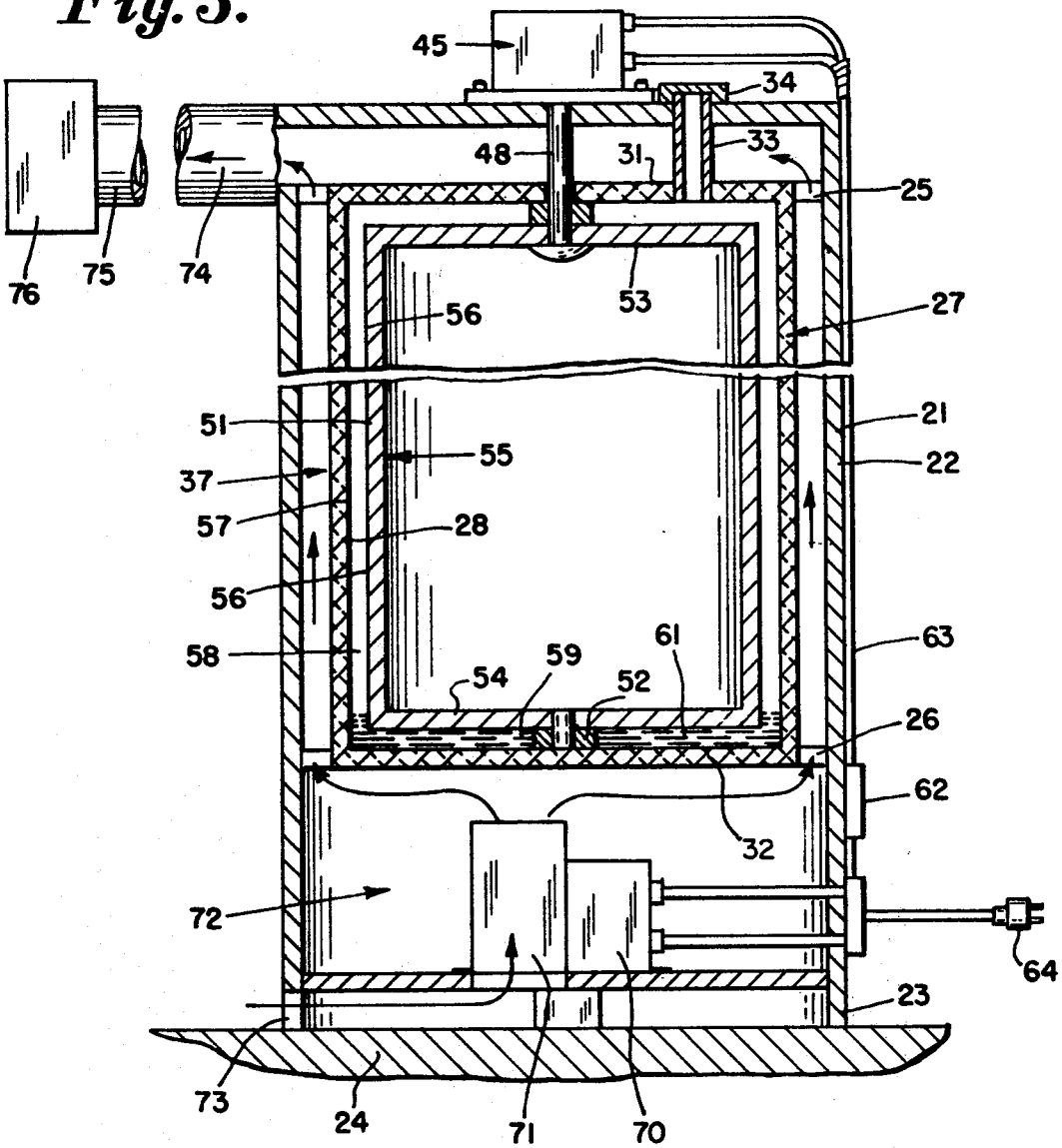
FIG. 3 is a view similar to FIG. 1 of the device of the invention in its preferred form.

FIGS. 1 and 2 illustrate one embodiment of the friction heat heater 20 of the invention which includes an upstanding, hollow, cylindrical housing 21 formed of imperforate sheet metal 22 and having legs 23 for supporting it on a floor 24 of a building. The space heater 20 is portable and in the portable embodiment illustrated in FIGS. 1 and 2 the housing 21 is of predetermined diameter of about twelve inches and of predetermined height of about thirty-two inches.

Fixed within housing 21 by suitable brackets 25 and 26 is a hollow cylindrical casing, or outer drum, 27 which is of predetermined diameter less than the diameter of the housing, such as ten inches, and is formed of aluminum sheeting 28 for efficient transfer of heat. The cylindrical side wall 29, top wall 31 and bottom wall 32 of casing 27 are imperforate to form a sealed enclosure except for the filler tube 33, which is closed by a removable threaded cap 34.

The casing 27 divides housing 21 into the lower air heating chamber 35, which it occupies and an upper fan chamber 36, there being an annular air chamber 37 formed between the cylindrical side wall 29 of the casing and the coaxial, concentric cylindrical side wall 38 of the housing 21.

Air inlet means 39 is provided in the lower portion of the housing 21 in the form of spaced apertures 41 extending around the cylindrical side wall 38 and air outlet means 42 is provided in the top 43 of the housing in the form of apertures 44. The annular air chamber 37 connects the air inlet means to the air outlet means of the fan chamber 36.

A reversible electric motor 45 is mounted in the fan chamber 36 with an eight bladed fan 46 fast on one end 47 of the motor shaft 48, each blade being of about 25° pitch and the motor being about one horse power for rotating the shaft 48 at between 1800–3600 R.P.M.

The other end 49 of motor shaft 48 extends into the air heating chamber 35 to rotate the hollow, cylindrical drum 51 which is supported in suitable bearings 52 for rotating around the central, vertical axis of the casing 27 and housing 21.

The inner drum 51 is sealed and hollow and includes the top wall 53, bottom wall 54 and cylindrical side wall 55, the walls being of stainless steel. The exterior cylindrical surface 56 of the cylindrical side wall 55 is smooth as is the interior, cylindrical surface 57 of the aluminum of the cylindrical side wall 29 of casing 27 and the surfaces 56 and 57 are at about one eight inch clearance from each other to form a narrow, annular liquid receptacle 58 therebetween.

It should be noted that the annular liquid receptacle 58 is not a passage through which liquid to be heated is continually flowed, as in the above mentioned prior art patents. Instead it is a sealed chamber and is provided with a supply of liquid lubricant 59 such as a quart of No. 10 oil which normally rests in the horizontal space, or shallow liquid receptacle 61 between the bottom wall 54 of the drum 51 and the bottom wall 32 of the casing 27.

It has been found that the best results are obtained when the lubricant 59 is Quaker State F-L-M-A-T Fluid, Ford Motor Company Qualifications No. 2P-670306 M 2633F. Unlike prior patents, no water is in contact with the oil.

The motor 45 is connected to a thermostat 62, of any well known type by cord 63 and to a source of electricity by male plug 64 so that it is energized under the control of ambient temperature by the signals of the thermostat.

In operation the motor 45 drives the drum 51 at a substantial speed, which causes the oil 59 to rise up into the annular liqud receptacle 58 to substantially fill the same. The heat of friction between the inner drum 51 and outer drum, or casing 27 is transferred by the oil while it prevents wear on the surfaces 56 and 57 so that the exterior aluminum surface 65 of the fixed outer drum 27 becomes heated. Meanwhile the large diameter, multibladed fan 46 is drawing ambient air through the air inlet means 39, thence up through the annular air chamber 37 and past the elongated heated surface 65 for discharge through the air outlet means 42 back into the room.

As shown in FIG. 3, it is preferable to provide a separate electric motor 70, usually about ⅛ H.P. and driving an air blower 71, these being mounted in a lower air chamber 72 for driving ambient air upwardly in an annular flow path in chamber 37 from the air inlet means 73 to the air outlet means 74. Air outlet means is the intake duct 75 of a hot air heating system 76 so that the heater 20 becomes a furnace rather than a space heater, the separate electric motor 70 enables the thermostat 62 to initiate rotation of the drum until a predetermined temperature is reached in the aluminum outer drum 27, whereupon the thermostat automatically deenergizes the drum motor 45 while continuing to rotate the separate fan, or flower motor such as 70, to furnish hot air to the room or heating system 76 until the casing 27 cools to a predetermined temperature.

I claim:

1. An odor-less, combustion-less, quiet beater comprising:

an inner, elongated, upstanding, hollow drum journalled within an outer, elongated, upstanding, hollow drum journalled within an outer, elongated upstanding drum to rotate in a horizontal plane on a vertical axis;

said inner drum having an outer, circumferential face spaced from the inner circumferential face of said outer drum by a fixed clearance of about one eighth of an inch to define an annular liquid receptacle therewith;

said inner drum having a lower diametrical face spaced from the lower diametrical face of said outer drum to define a shallow liquid receptacle therewith;

a supply of oil normally occupying only said shallow liquid receptacle but adapted to be raised upwardly into said annular liquid receptacle when said inner drum is rotated on said vertical axis at substantial speed;

and electric motor means for rotating said inner drum on said vertical axis within said outer drum to heat said oil and transfer heat to the outer face of said outer drum.

2. A heater as specified in claim 1 wherein:

said inner drum and said outer drum are both cylindrical in configuration.

3. A heater as specified in claim 1 wherein said inner drum is a sealed hollow cylinder and said outer drum is a sealed hollow cylinder except for an oil conduit connecting said annular liquid receptacle and said shallow liquid receptacle to outside said outer drum.

4. A heater as specified in claim 1 plus:

housing means extending around said outer drum, including an air inlet and an air outlet and an electric motor operated fan within said housing for drawing air into said inlet, circulating said air around said outer drum and blowing air out of said outlet.

5. An odor-less, flameless, noiseless, heater comprising:

an inner, cylindrical, sealed, hollow metal drum telescoped within an outer cylindrical, hollow, metal drum, said drums having upstanding cylindrical side walls spaced apart with a fixed clearance of about one eighth of an inch to form an annular, vertical, liquid, receptacle and having bottom walls spaced apart a predetermined distance to form a shallow, horizontal liquid receptacle an electric motor operably connected to one said drum to rotate the same on a vertical axis relative to the other at a substantial speed, and a supply of oil normally occupying only said shallow liquid receptacle but rising into said annular liquid receptacle, when one said drum is so rotated, to transfer frictional heat to said drums.

6. A combination as specified in claim 5 wherein:

said oil is a light oil and is normally in contact with both the bottom wall of said inner drum and the bottom wall of said outer drum.

7. A combination as specified in claim 5 plus:

a housing extending around said telescoped drums and electric motor operated fan means in said housing for drawing ambient air into said housing, around said drums and dischargeing it out of said housing.

8. The method of generating heat in an odorless, flame-less noiseless manner by means of an outer, stationary, member and an inner member, rotatably mounted within said outer member, there being a supply of oil within said outer member, said method comprising the steps of forming said members as hollow drums, one telescoped within the other, and both upstanding vertically so that the inner drum rotates on a central vertical axis relative to the outer drum and so that there is a clearance space between drums of only about one eighth of an inch in width, limiting the supply of oil within said outer drum to a predetermined quantity so that it normally occupies only the bottom of the said clearance space and then rotating said inner drum at substantial speed within said outer drum to heat said oil, cause it to rise up into said clearance space and transfer heat to said outer drum.

* * * * *

UNITED STATES PATENT OFFICE

CERTIFICATE OF CORRECTION

Patent No. 4,143,639 Dated March 13, 1979

Inventor(s) Eugene J. Frenette

It is certified that error appears in the above-identified patent and that said Letters Patent are hereby corrected as shown below:

Col. 3, line 22 for flower read "blower"

Claim 1, line 26 for beater read "heater"

Claim 1, lines 30-31 Cancel the second occurrence of "journalled within an outer elongated upstanding drum"

Signed and Sealed this

*Twenty-sixth* Day of *June 1979*

[SEAL]

*Attest:*

RUTH C. MASON
*Attesting Officer*

DONALD W. BANNER
*Commissioner of Patents and Trademarks*